US011219981B2

(12) United States Patent
Paduano et al.

(10) Patent No.: US 11,219,981 B2
(45) Date of Patent: Jan. 11, 2022

(54) PORTABLE SURFACE CLEANING APPARATUS

(71) Applicant: Eclipse Surface Technologies, LLC, Hatfield, PA (US)

(72) Inventors: Jeffrey Paduano, Milford, NJ (US); Henry Schmalzried, Sellersville, PA (US)

(73) Assignee: Eclipse Surface Technologies, LLC, Hatfield, PA (US)

( * ) Notice: Subject to any disclaimer, the term of this patent is extended or adjusted under 35 U.S.C. 154(b) by 711 days.

(21) Appl. No.: 16/129,016

(22) Filed: Sep. 12, 2018

(65) Prior Publication Data

US 2019/0076988 A1 Mar. 14, 2019

Related U.S. Application Data

(60) Provisional application No. 62/557,222, filed on Sep. 12, 2017.

(51) Int. Cl.

| | |
|---|---|
| ***B24C 3/06*** | (2006.01) |
| ***B24C 5/04*** | (2006.01) |
| ***B24C 7/00*** | (2006.01) |
| *B08B 5/02* | (2006.01) |
| *B05B 7/14* | (2006.01) |

(52) U.S. Cl.

CPC ..... *B24C 3/06* (2013.01); *B24C 3/067* (2013.01); *B24C 7/0007* (2013.01); *B24C 7/0046* (2013.01); *B05B 7/1481* (2013.01); *B08B 5/02* (2013.01); *B24C 5/04* (2013.01)

(58) Field of Classification Search

CPC .. B24C 3/06; B24C 3/067; B24C 5/04; B24C 7/0007; B24C 7/0023; B24C 7/0038; B24C 7/0046; B24C 7/0061; B24C 7/0084; B05B 7/1481

USPC ..... 451/90, 92

See application file for complete search history.

(56) References Cited

U.S. PATENT DOCUMENTS

| | | | | | |
|---|---|---|---|---|---|
| 4,233,785 | A * | 11/1980 | Abell | B24C 5/04 | 451/102 |
| 4,339,897 | A * | 7/1982 | Thompson | B24C 7/0046 | 137/595 |
| 4,534,139 | A * | 8/1985 | Desjardins | B24C 7/0046 | 451/101 |
| 4,709,515 | A * | 12/1987 | Copeland | B24C 5/04 | 222/132 |

(Continued)

FOREIGN PATENT DOCUMENTS

| | | |
|---|---|---|
| WO | 2008/035236 A1 | 3/2008 |
| WO | 2008/035238 A1 | 3/2008 |
| WO | 2016/020877 A1 | 2/2016 |

*Primary Examiner* — Eileen P Morgan

(74) *Attorney, Agent, or Firm* — Howson & Howson LLP

(57) ABSTRACT

A micro-abrasion sandblast device having a tank for containing a supply of abrasive media and having a media outlet on a base thereof and a cabinet attached to the tank and providing a first inlet to which an external source of compressed air is connectable and a second inlet to which an external source of water is connectable. A media valve is located adjacent the base of the tank for receiving media from the media outlet and compressed air from the cabinet. A blast hose coupler connects to and extends from the media valve for receiving the media and compressed air from the media valve.

14 Claims, 6 Drawing Sheets

(56) References Cited

U.S. PATENT DOCUMENTS

| | | | | | |
|---|---|---|---|---|---|
| 5,421,766 | A * | 6/1995 | Shank, Jr. | B24C 5/04 | 239/591 |
| 5,421,767 | A * | 6/1995 | Spears, Jr | B24C 5/04 | 451/101 |
| 5,484,325 | A * | 1/1996 | Shank | B24C 5/00 | 451/102 |
| 5,542,873 | A * | 8/1996 | Shank, Jr. | B24C 5/04 | 451/101 |
| 8,057,279 | B2 * | 11/2011 | Connelly | B24C 7/0046 | 451/2 |
| 9,056,328 | B2 | 6/2015 | Giovannini | | |
| 10,875,151 | B2 * | 12/2020 | Grau | B24C 7/0023 | |
| 2005/0003747 | A1 * | 1/2005 | Dore | B24C 7/0038 | 451/90 |
| 2016/0236323 | A1 * | 8/2016 | Mase | B24C 5/02 | |
| 2019/0275640 | A1 * | 9/2019 | McKenna | B24C 7/0084 | |
| 2020/0108484 | A1 * | 4/2020 | Kavka-Coogan | B24C 1/086 | |

* cited by examiner

PORTABLE SURFACE CLEANING APPARATUS

CROSS REFERENCE TO RELATED APPLICATIONS

This application claims the benefit under 35 USC § 119(e) of U.S. Provisional Patent Application No. 62/557,222, filed Sep. 12, 2017.

BACKGROUND

The present invention relates to a micro-abrasion sandblaster powered by compressed air for cleaning a surface via surface blasting with abrasive media.

A typical sandblasting procedure includes directing a jet of compressed air and abrasive material from a hand-held nozzle onto a surface to remove an unwanted layer of material from the surface, thereby cleaning the surface. The abrasive material may include various types of abrasive particles, powder, and/or other media. The nozzle typically has a trigger or like mechanism by which the operator turns the spray of compressed air and abrasive material on and off. Merely for purposes of example, a sandblaster may be used to remove a layer of paint, coatings, rust, or corrosion from metal, stone, masonry, or like surfaces, for cleaning soft stones and architectural works (such as for historic preservation of buildings and like structures), and for preparing a surface for application of a new coating.

SUMMARY

According to an embodiment, a micro-abrasion sandblast device is provided. The device has a tank for containing a supply of abrasive media, a media outlet on a base thereof, and a cabinet attached to the tank and providing a first inlet to which an external source of compressed gas, such as compressed air, may be connected and a second inlet to which an external source of liquid, such as water, may be connected. A media valve is located adjacent the base of the tank for receiving media from the media outlet and compressed gas or air from the cabinet. A blast hose coupler connects to the media valve for receiving the media and compressed gas or air from the media valve and liquid or water from tubing extending from the cabinet so that the liquid or water is first mixed with the media and compressed gas or air at the blast hose coupler.

BRIEF DESCRIPTION OF THE DRAWINGS

The foregoing and other objects, features and advantages of the embodiments disclosed herein should become apparent from the following description when taken in conjunction with the accompanying drawings.

DETAILED DESCRIPTION

Figure 1:
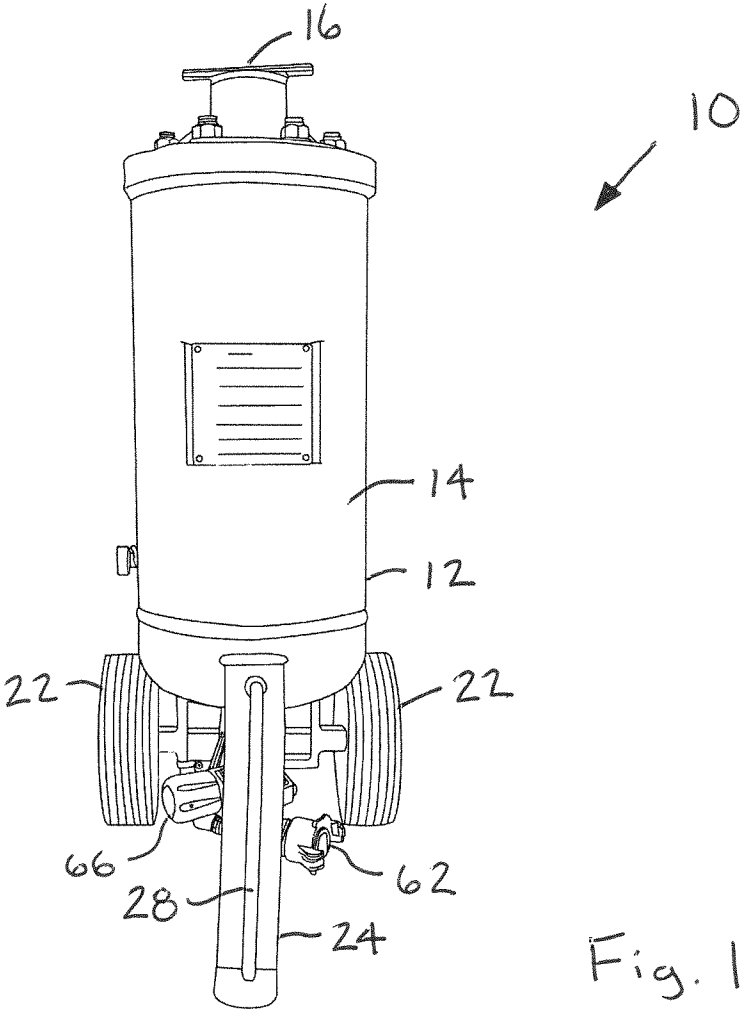
FIG. 1 is a front perspective view of a portable micro-abrasion sandblast machine according to an embodiment.
Figure 2:
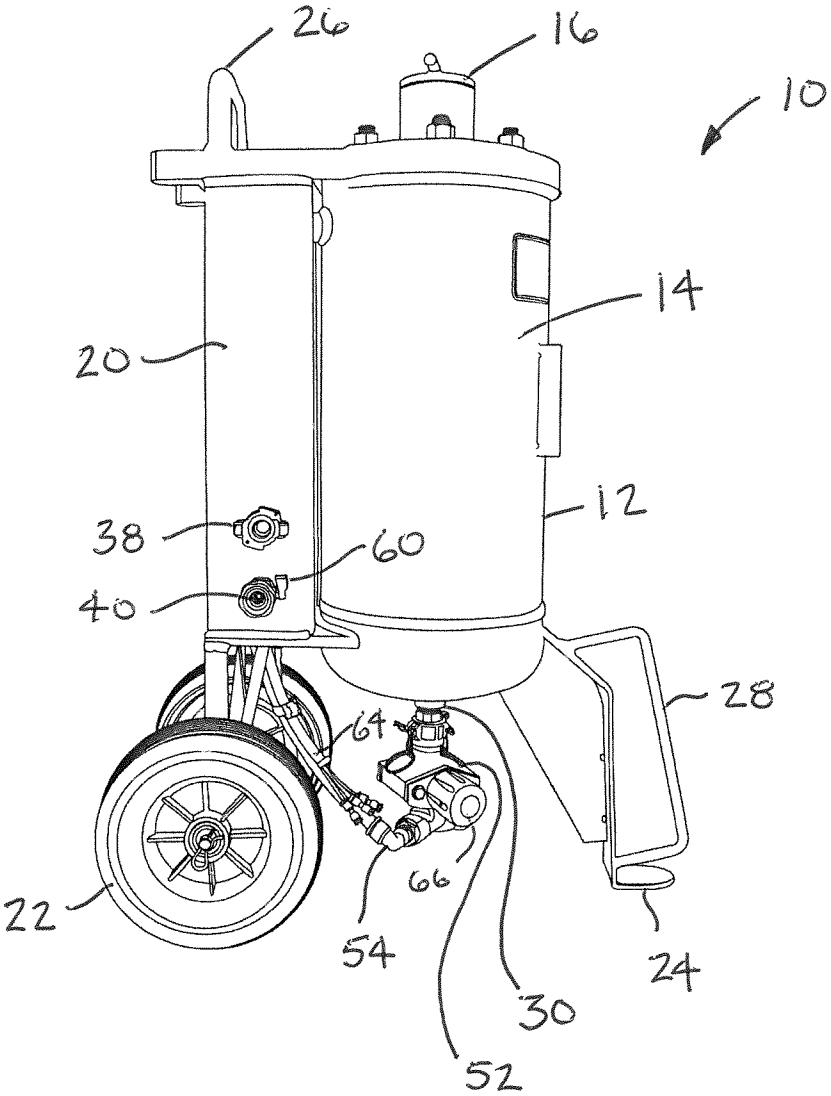
FIG. 2 is a left-side perspective view of the portable micro-abrasion sandblast machine of FIG. 1.
Figure 3:
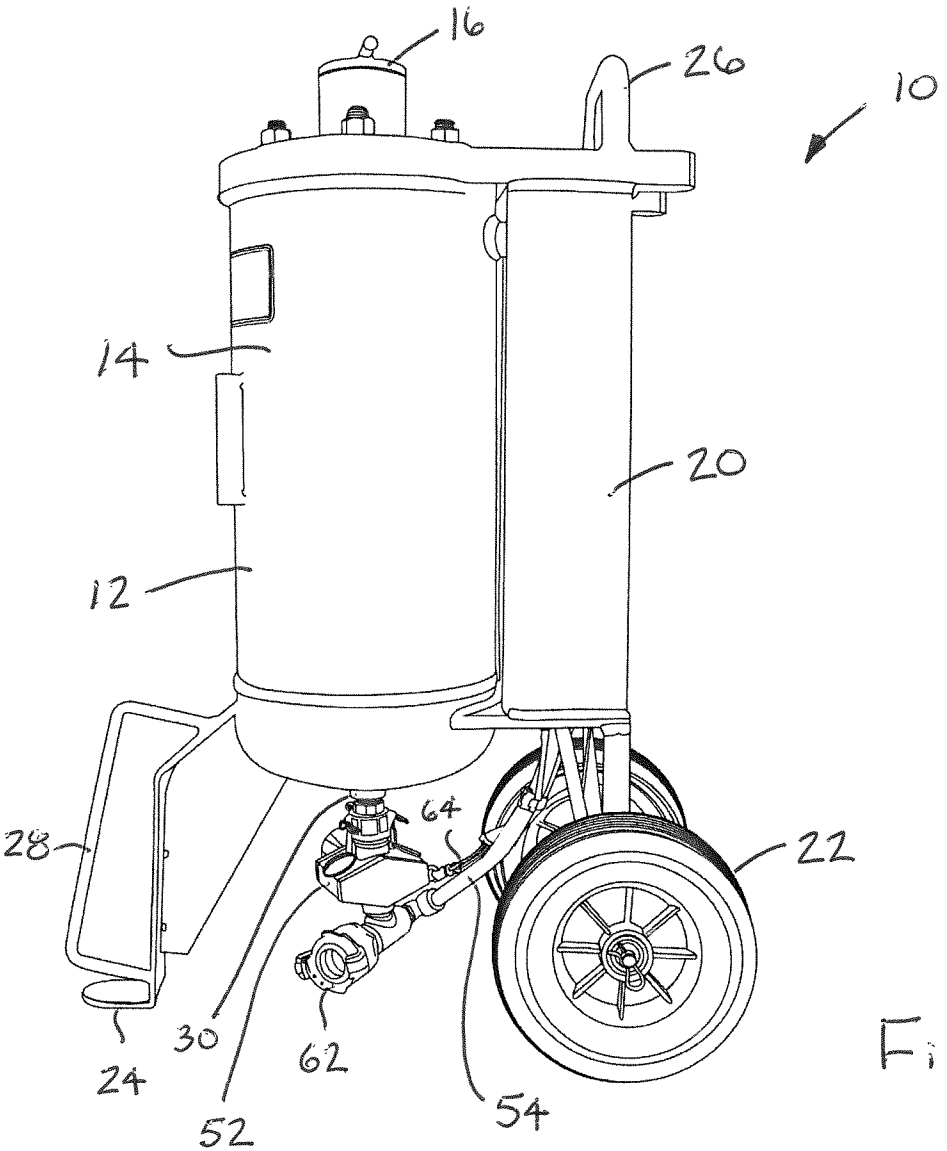
FIG. 3 is a right-side perspective view of the portable micro-abrasion sandblast machine of FIG. 1.
Figure 4:
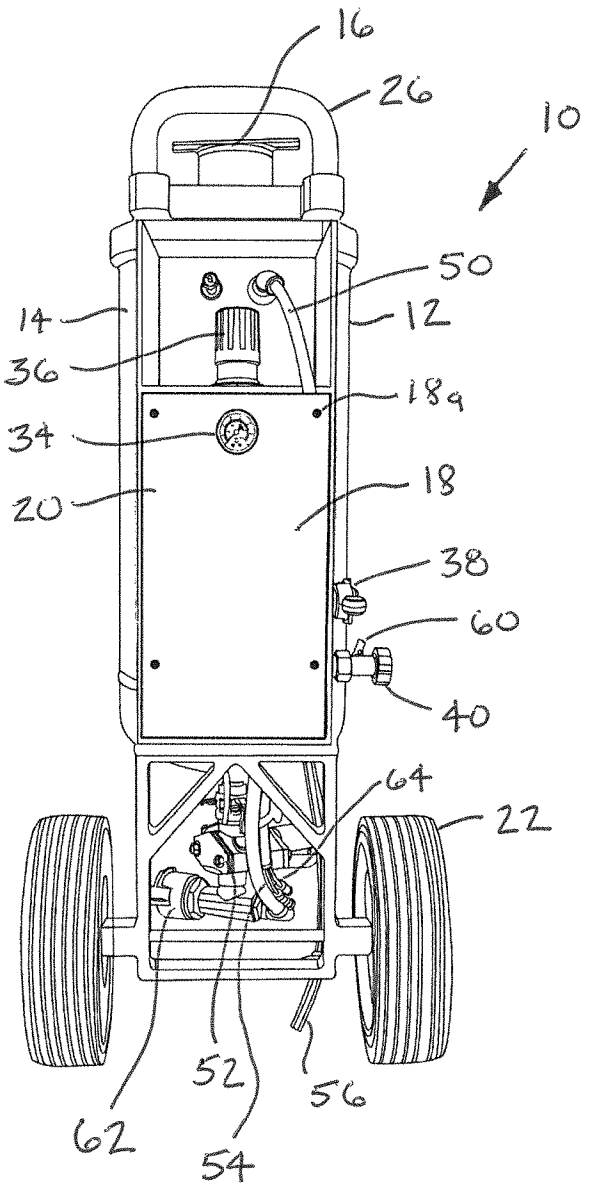
FIG. 4 is a rear perspective view of the portable micro-abrasion sandblast machine of FIG. 1.

For simplicity and illustrative purposes, the principles of the embodiments are described by referring mainly to examples thereof. In the following description, numerous specific details are set forth in order to provide a thorough understanding of the embodiments. It will be apparent however, to one of ordinary skill in the art, that the embodiments may be practiced without limitation to these specific details. In some instances, well known methods and structures have not been described in detail so as not to unnecessarily obscure the embodiments.

According to an embodiment a micro-abrasion sandblast machine 10 is provided for performing sandblasting and cleaning operations. The machine 10 is adapted to accept and use various forms of media and abrasives, such as particulate abrasive material, with compressed gas to blast surfaces within a range of pressures, for instance, adjustable from 3 psi to 120+ psi. The compressed gas may be air or any other gas of desire. In addition, the machine 10 is capable of being used with or without water or other liquid depending on desired application in any of various industries. For instance, the liquid may comprise primarily water with a small amount of rust inhibitor additive or other additive. Merely by way of example, the machine 10 may be used in operations of removing old coatings, paint, rust, grease, dirt, and other contaminants from building facades, objects, equipment, cars, boats, parts, and the like.

According to an embodiment, the micro-abrasion sandblast machine 10 may be provided with a portable body 12. The body 12 may include a sealable hollow tank, or blast pot, 14 for containing abrasive media, a removable and resealable lid 16 for an opening on the top of the tank 14, a cabinet 20 housing an enclosed control panel located adjacent a rear of the tank 14, a pair of wheels 22 positioned below the cabinet 20, and a kickstand 24 located adjacent a front of a bottom of the tank 14.

The lid or cap 16 is removable to enable the tank 14 to be filled with abrasive media and, when installed on the tank 14, permits the tank 14 to be safely pressurized during operation. An operator may fill the vessel with media by removing the lid or cap 16 and by using a funnel or the like to pour the media into the tank 14 through the top opening of the tank 14. By way of example, the tank 14 may be configured to provide a capacity of about 1 cubic foot to enable the tank to hold about 50 lbs. of media per fill, depending on the media being used. After the tank 14 is filled with media, the lid or cap 16 is applied to seal the opening. As an example, the means for removing and/or securing the lid or cap 16 to the tank 14 may be via the use of complementary screw threads.

The wheels 22 permit the body 12 to be portable and readily moved into a desired position, and the combination of the wheels 22 and kickstand 24 permit the body 12 to stand upright without other support. The body 12 may also include a set of handles, 26 and 28, located at the top of the cabinet 20 and on the front of the kickstand 24, respectively, to further aid in moving and positioning the tank 14.

The bottom of the tank 14 includes an outlet 30 through which the abrasive material flows from the tank during operation. The tank 14 may be of all welded aluminum construction yet also permits access to the interior of the vessel for maintenance purposes. For example, the tank 14 may be made from a cylindrical body welded to a base and welded to an upper wall. The base of the tank may be cone-shaped. This allows for more consistent and even media flow through the outlet 30 located at the center of the bottom of the tank 14 at the lowest part of the cone-shape. This is particularly important when using relatively soft medias, such as sodium bicarbonate.

Figure 5:
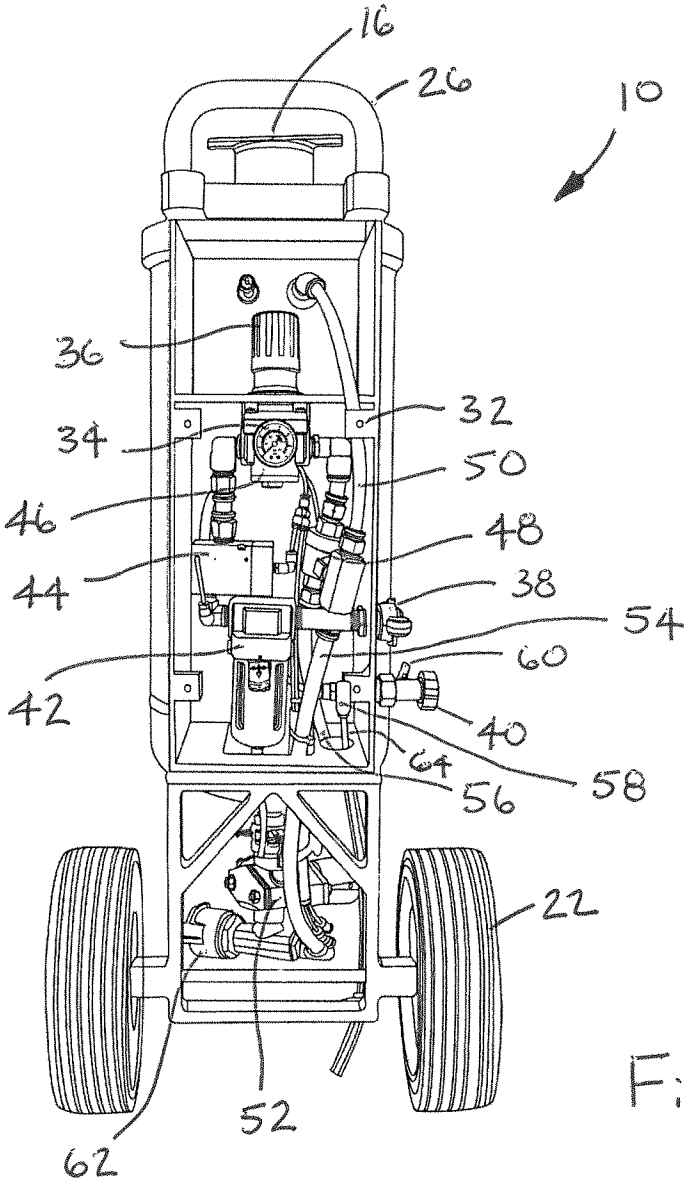
FIG. 5 is a rear perspective view of the portable micro-abrasion sandblast machine of FIG. 1 with the rear panel removed.

The components housed within the cabinet 20 of the body 12 are shown in FIG. 5. A cover panel 18 is mounted with fasteners 18*a* via the mounting apertures 32 located along the rear periphery of a lower portion of the cabinet 20 for purposes of enclosing at least the lower portion of the cabinet 20. When the cover panel 18 is secured to the cabinet 20, the components within the cabinet 20 are fully enclosed and protected thereby reducing the chances of accidental damage. The only exception is that the panel has a viewing window to permit a pressure gauge 34 to be readily viewable by an operator. In addition, a knob 36 is located above the enclosed portion of the cabinet 20 and may be used by an operator to adjust and control pressure during an operation.

A side of the cabinet 20 includes a first inlet 38 for compressed air and a second inlet 40 for water or like liquid. The air inlet 38 connects an external source of compressed air to an air filter/moisture trap 42 located within the enclosed portion of the cabinet 20. The moisture trap 42 interconnects to a flow control valve 44 which receives communications from a trigger or the like located at the end of a spray nozzle 70 of a blast hose 72 held by an operator. When the trigger is depressed, pulled or otherwise activated by the hand of the operator, the flow control valve 44 opens to permit the compressed air to flow to a pressure regulator 46. Otherwise, the flow control valve 44 closes the flow path of the compressed air through the machine 10.

The pressure regulator 46 includes the knob 36, discussed above, that is used to adjust and control operating air pressure during an operation. By way of example, an operator may use knob 36 to adjust blast pressure from about 20 psi to about 100+ psi. The regulator 46 interconnects to a three-way control valve 48. When the trigger of the spray nozzle 70 is pulled by the operator, the machine 10 is activated and the three-way control valve 48 directs compressed air at the set pressure to flow through hose 50 into the tank 14 adjacent the top of the tank 14 thereby pressurizing the tank 14 and directs compressed air at the set pressure to a media valve 52 located at the base of the tank 14 via hose 54 so that blasting may take place. In addition, when the trigger is released by the operator, the three-way control valve 48 enables air to be exhausted from the tank via hose 56 to enable the tank 14 to depressurize.

The water inlet 40 connects an external source of water or other liquid to a pilot water valve 58 located within the enclosed portion of the cabinet 20. The pilot water valve 58 automatically opens when the trigger on the blast hose is pulled by the operator and closes otherwise. The inlet 40 also includes an external valve 60 located outside of the enclosed cabinet 20 and fully accessible to an operator. If an operator desires dry-blasting without water, the external valve 60 is closed by the operator (i.e., turned to a closed position). Thus, the supply of water is cut off. However, if an operator desires wet-blasting, the external valve 60 is opened by the operator (i.e., turned to a valve open position). Thus, the supply of water is controlled by the pilot water valve 58. By way of example, when valves 58 and 60 are open, the rate of flow of water through the machine may be about 15 gallons per hour.

Figure 6:
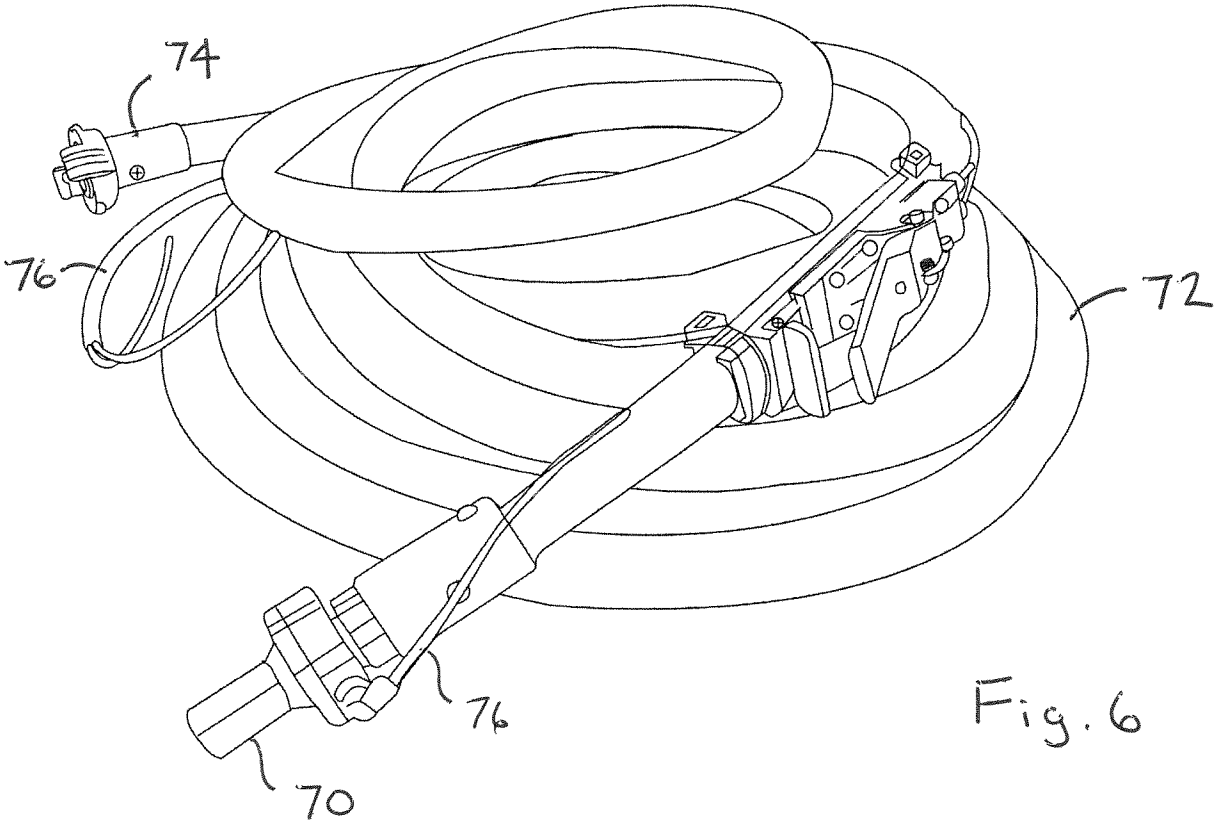
FIG. 6 is a perspective view of a blast hose for use with the portable micro-abrasion sandblast machine of FIG. 1.

The media valve 52 connects to the outlet 30 of the tank 14 providing a flow of media and connects to the hose 54 providing a flow of compressed air. A blast hose coupler 62 extends from the media valve 52 and interconnects to a coupler 74 of the blast hose 72 which has a spray nozzle 70 with a trigger or other mechanism (see FIG. 6) at an opposite end thereof. Additional hardware and tubing 64 connects a supply of water from the pilot water valve 58 to the blast hose coupler 62 at the base of the blast hose (not shown). Alternatively, the tubing 64 is connected to a water line 76 of the blast hose 72 for delivery to the spray nozzle 70. The media valve 52 includes a control knob 66 to permit an operator to manually adjust the amount of media which is permitted to pass through the media valve 52. For instance, adjustments may be made to permit only a few grains of abrasive media to pass through the media valve 52 or a steady stream of abrasive media to flow through the valve 52.

Accordingly, an operator desiring use of the machine 10, first fills the tank 10 with abrasive media via the top opening and then seals the top opening with the lid 16. If dry-blasting is desired, the external water valve 60 is placed in the closed position to prevent the flow of water through the machine 10. In addition, the knob 36 of the pressure regulator 46 is set to a desired pressure, and the knob 66 is set to provide a desired amount of media to be mixed with the compressed air. Thereafter, the trigger of the spray nozzle is pulled or activated by the operator. At this point, air at the selected pressure is permitted to enter and pressurize the tank 14. The air pressure creates a downward force inside the tank 14 to push media out the bottom of the tank and through the media valve 52. The media continues to flow through the media valve 52 and through the blast hose with compressed air supplied by hose 54 and is sprayed out the nozzle. The operator directs this spray on the work surface to be cleaned.

If wet-blasting is desired (i.e., a mixture of abrasive media, compressed air, and water), the operator manually places the external water valve 60 into the open position. The amount of opening of the valve 60 determines the actual volume of water that flows through the system. Thereafter, when the operator pulls the trigger on the spray nozzle, the water pilot valve 58 automatically opens to allow water to flow to the base of the blast hose 72 or into the spray nozzle 70 of the blast hose 72. Once water is delivered to the blast hose or spray nozzle, as discussed above, it mixes with the air and abrasive and is sprayed out of the spray nozzle 70. This mode of operation allows for so-called "dustless blasting", as the water surrounds the media and reduces the dust that is typically generated during a blasting operation. The reduction in dust is approximately 92%. By mixing water at the base of the blast hose, the water has more time to thoroughly mix with media before being discharged from the spray nozzle and provides a superior manner of way to suppressing and controlling dust.

The above description illustrates an embodiment of how aspects of the present invention may be implemented, and are presented to illustrate the flexibility and advantages of particular embodiments as defined by the following claims, and should not be deemed to be the only embodiment. One of ordinary skill in the art will appreciate that based on the above disclosure and the following claims, other arrangements, embodiments, implementations and equivalents may be employed without departing from the scope hereof as defined by the claims.

Accordingly, the specification and figures are to be regarded in an illustrative rather than a restrictive sense, and all such modifications are intended to be included within the scope of the present invention. The benefits, advantages, solutions to problems, and any element(s) that may cause any benefit, advantage, or solution to occur or become more pronounced are not to be construed as a critical, required, or essential features or elements of any or all the claims. The invention is defined solely by the appended claims.

We claim:

1. A micro-abrasion sandblast device, comprising:

a tank for containing a supply of abrasive media and having a media outlet on a base thereof;

a cabinet attached to said tank and providing a first inlet to which an external source of compressed gas is connectable and a second inlet to which an external source of liquid is connectable;

a media valve located adjacent said base of said tank for receiving media from said media outlet and compressed gas from said cabinet;

a blast hose coupler connected to said media valve for receiving the media and compressed gas from the media valve; and a blast hose having a first end connected to said blast hose coupler and a second end to which a spray nozzle having a trigger is attached;

wherein said device includes an on/off valve associated with said second inlet for permitting or preventing a flow of liquid from said second inlet into said device such that, when flow is prevented by said valve, said device is operable in a dry-blasting mode without liquid, and when flow is permitted by said valve, said device is operable in a wet-blasting mode with liquid; and wherein, when operating in a wet-blasting mode, the liquid is first caused to be mixed with the media and compressed gas at said blast hose coupler or within said spray nozzle of said blast hose such that the tank remains dry containing only the abrasive media and gas from the source of compressed gas connected to said first inlet used to pressurize said tank.

2. The micro-abrasion sandblast device according to claim 1, wherein said tank has a cylindrical tank body and a cone-shaped base welded to said cylindrical body.

3. The micro-abrasion sandblast device according to claim 2, wherein said tank has an upper wall welded to said cylindrical tank body.

4. The micro-abrasion sandblast device according to claim 2, wherein, during use, said tank provides a capacity of at least about 1 cubic foot and is adapted to be pressurized up to at least 100 psi.

5. The micro-abrasion sandblast device according to claim 1, wherein said cabinet houses a pilot valve interconnected to said second inlet, said pilot valve being adapted to receive signals from the trigger of the spray nozzle of the blast hose to control the flow of liquid from said pilot valve and into said blast hose coupler or spray nozzle.

6. The micro-abrasion sandblast device according to claim 1, wherein said liquid comprises water.

7. The micro-abrasion sandblast device according to claim 1, wherein said cabinet houses a moisture trap, a flow control valve, a pressure regulator, and a three-way control valve, wherein said moisture trap interconnects to said first inlet and receives a flow of compressed gas from said first inlet, wherein said flow control valve interconnects to said moisture trap and is adapted to receive signals from a hand held the trigger of the spray nozzle of the blast hose to permit the flow of compressed gas or to prevent the flow of compressed gas through the flow control valve, wherein said pressure regulator interconnects to said flow control valve and regulates pressure of the flow of compressed gas that is permitted to flow from the flow control valve to the three-way control valve, and wherein said three-way control valve directs the compressed gas into said tank to pressurize said tank to force media into said media valve and directs compressed gas directly into said media valve via a hose during a blasting operation in the dry-blasting mode and the wet blasting mode and exhausts gas from said tank via an exhaust hose to depressurize the tank when the blasting operation is halted.

8. The micro-abrasion sandblast device according to claim 7, wherein said pressure regulator includes a knob for adjusting the pressure at which the compressed gas is permitted to enter the tank and the media valve.

9. The micro-abrasion sandblast device according to claim 8, wherein said pressure regulator permits the pressure to be adjusted from about 3 psi to about 120 psi and includes a pressure gauge.

10. The micro-abrasion sandblast device according to claim 1, wherein said compressed gas is compressed air, wherein said cabinet extends from a rear of said tank, and wherein said cabinet includes a cover.

11. The micro-abrasion sandblast device according to claim 1, wherein said tank includes a fill opening through which said tank is filled with media.

12. The micro-abrasion sandblast device according to claim 1, further comprising wheels and a kickstand to permit the micro-abrasion sandblast device to be portable and to permit the tank to be self-supporting in a stable upright position.

13. The micro-abrasion sandblast device according to claim 1, wherein said media valve includes an adjustment knob permitting manual adjustment of an amount of media permitted to flow out of said tank.

14. The micro-abrasion sandblast device according to claim 1, wherein the abrasive media is particulate abrasive material.

* * * * *